US005764181A

United States Patent [19]

Fey et al.

[11] Patent Number: 5,764,181

[45] Date of Patent: Jun. 9, 1998

[54] SILICONE COMPOSITIONS CONTAINING CARBONYL IRON POWDER

[75] Inventors: Kenneth C. Fey, Midland; Robert D. Rivet; Donald F. Sprygada, both of Bay City; Terence J. Swihart, Essexville, all of Mich.

[73] Assignee: Dow Corning Corporation, Midland, Mich.

[21] Appl. No.: 466,704

[22] Filed: Dec. 21, 1989

[51] Int. Cl.[6] ..... H01Q 17/00; D04H 1/00

[52] U.S. Cl. ..... 342/4; 428/145; 428/266

[58] Field of Search ..... 342/1–4, 428; 428/145, 266, 900, 408

[56] References Cited

U.S. PATENT DOCUMENTS 4,719,142 1/1988 Modic ..... 428/145

4,725,490 2/1988 Goldberg ..... 428/292

*Primary Examiner*—Peter A. Nelson

*Attorney, Agent, or Firm*—Larry A. Milco

[57] ABSTRACT

Radar attenuating compositions comprising a low viscosity siloxane polymer, a resinous crosslinker therefor and carbonyl iron powder have improved thermal stability when exposed to temperatures as high as 450° F. The particular crosslinker that is used in the compositions of this invention provides improved stability for the compositions at room temperature storage conditions and also in the cured form. The compositions can be sprayed and/or molded and cured at room temperature and/or elevated temperatures, as desired.

10 Claims, No Drawings

SILICONE COMPOSITIONS CONTAINING CARBONYL IRON POWDER

The Government has rights in this invention pursuant to Contract No. F33615-83-C-5084, awarded by the Department of the Air Force.

BACKGROUND OF THE INVENTION

The present invention relates to improved organopolysiloxane compositions comprising carbonyl iron powder, herein also referred to as CIP for convenience. More specifically, the present invention relates to CIP-containing, room-temperature curing silicone composition which are useful as coating compositions, injection-moldable compositions and sealant compositions which also have improved high-temperature resistance in the cured form.

Previously, CIP-containing silicone compositions have required that the CIP received a treatment, in one way or another, to stabilize the composition, even during uncatalyzed storage. It was believed that this treatment reduced or eliminated a reaction between the CIP and the particular resinous crosslinker that was used to cure the composition. See U.S. Pat. No. 4,731,191 to Swihart; application Ser. No. 815,437 to Blizzard, filed on Dec. 31, 1985; application Ser. No. 815,436 to Fey, filed on Dec. 31, 1985; and application Ser. No. 360,949 to Fey, filed on May 1, 1989; all assigned to the assignee of this invention. While the compositions of these disclosures possess adequate storage stability at room temperature they lack the desired stability at elevated temperatures in the cured state for some applications.

BRIEF SUMMARY OF THE INVENTION

It is an object of the present invention to provide CIP-containing silicone compositions which do not require a special treatment of the CIP. It is another object of this invention to provide CIP-containing silicone compositions that have improved high temperature resistance. It is yet another object of this invention to provide CIP-containing silicone compositions which are useful for making injection-molded articles. It is also an object of this invention to provide CIP-containing silicone compositions which cure at room temperature to the same extent as when heated.

These objects, and others which will become apparent to one of ordinary skill in the silicone arts upon consideration of the following disclosure and appended claims, are obtained by the compositions of the present invention which, briefly stated, comprise a curable mixture of an alkenyl-substituted polydiorganosiloxane, an alkenyl-substituted resinous organopolysiloxane, a resinous organohydrogenpolysiloxane crosslinker, a catalyst to promote the addition reaction of silicon-bonded alkenyl radicals with silicon-bonded hydrogen atoms, a catalyst inhibitor to provide a suitable pot-life for the composition, and carbonyl iron powder.

The compositions of this invention are useful as coatings, sealants, press-molded sheet stock, injection-molded articles, etc. which retain elastomeric properties after being cured and exposed to high temperature, such as 450 degrees F. for hundreds of hours.

DETAILED DESCRIPTION OF THE INVENTION

The present invention relates to a composition comprising (A) a polydiorganosiloxane which contains an average of at least two alkenyl radicals per molecule, the remaining organic radicals therein using at least 90 percent methyl radicals and up to 10 percent phenyl radicals.

(B) a silicone resin component comprising $R'R^2_2SiO_{1/2}$ siloxane units, $R^2_3SiO_{1/2}$ siloxane units and $SiO_{4/2}$ siloxane units in a ratio of 0.1/0.6/1.0 to 0.25/0.9/1.0 wherein $R^1$ denotes an alkenyl radical and $R^2$ denotes a methyl or phenyl radical.

(C) An organohydrogenpolysiloxane having the formula $M_xQ$ wherein M denotes a siloxane unit having the formula $R^3R^2_2SiO_{1/2}$, Q denotes a siloxane unit having the formula $SiO_{4/2}$, x has a value of from 1.4 to 2.0, $R^3$ denotes H or $R^2$ and $R^2$ denotes methyl or phenyl, the amount of silicon bonded hydrogen atoms therein being 0.5 to 1.0 percent by weight, based on the weight of the organohydrogenpolysiloxane.

(D) a platinum containing component in an amount sufficient to increase the curing rate of the composition at room temperature, (E) an inhibitor component in an amount sufficient to provide a work time for the composition at room temperature, and (F) from 50 to 90 percent by weight, based on the weight of the composition, of carbonyl iron powder; the amounts of (A), (B), and (C) being sufficient to provide from 0.5 to 1.5 silicon bonded hydrogen atoms for every silicon bonded alkenyl radical in the composition and from 10 to 100 parts by weight of (B) for every 100 parts by weight of (A).

Component (A) is a polydiorganosiloxane having the formula $R_3SiO(R_2SiO)_aSiR_3$ wherein R denotes methyl, phenyl or an alkenyl radical having from 1 to 7 carbon radicals such as vinyl, allyl, butenyl, pentenyl and hexenyl; with at least two R radicals per molecule being alkenyl. For heat resistance for the composition it is preferred that R be limited to vinyl, methyl and phenyl; and most preferably to vinyl and methyl for maximum heat resistance and maximum flexibility for the cured composition at low temperature. The value of (A) in the formula immediately above can have any value as long as the polydiorganosiloxane has a viscosity of from about 100 to 100,000 centipoise, preferably from 500 to 50,000 centipoise and most preferable from about 1,000 to 5,000 centipoise at 25 degrees C. A preferred organopolysiloxane for the compositions of this invention is a vinyl-terminated polydimethylsiloxane, optionally containing up to about 10 mol percent of methylphenylsiloxane units. Component (A) is a well known material in the silicone art and needs no further delineation as to its detailed structure and its preparation.

Component (B) is an alkenyl radical containing resinous material which is also well known in the silicone arts. Component (B) has the general formula $R_3SiO_{1/2}/SiO_{4/2}$ wherein R has the meaning noted above for component (A). The ratio of monovalent siloxane units to tetravalent siloxane units of Component (B) is from 0.1/1.0 to 1.1/1.0.

Component (B) having the above formula is composed of $R^1R^2_2SiO_{1/2}$ siloxane units, $R^2_3SiO_{1/2}$ siloxane units and $SiO_{4/2}$ siloxane units in a molar ratios of from 0.1/0.6/1.0 to 0.2/0.9/1.0 and wherein $R^1$ denotes an alkenyl radical and $R^2$ denotes a methyl or phenyl radical. Preferably $R^1$ denotes a vinyl radical and $R^2$ denotes a methyl radical in this component.

Component (B) can be prepared according to the teachings of U.S. Pat. No. 2,676,182 to Daudt and Tyler and U.S. Pat. No. 4,537,829 to Blizzard and Swihart, which are incorporated herein by reference to show how to prepare component (B).

Component (C) functions as a crosslinker for the fluid polymer (A) and the resin polymer (B). Component (C) has the general formula $M_xQ$ wherein M denotes a monovalent siloxane unit having the formula $R^3R^2_2SiO_{1/2}$ wherein $R^3$ denotes a hydrogen atom or an $R^2$ radical, and Q denotes a tetravalent siloxane unit having the formula $SiO_{4/2}$. $R^2$ in this component has the same meaning as stated above for components (A) and (B) and is preferably methyl. The amount of siloxane units bearing silicon-bonded hydrogen atoms is such as to provide 0.5 to 1.0 percent by weight silicon-bonded hydrogen atoms in the component (C). Component (C) is preferably composed of $HR^2_2SiO_{1/2}$ siloxane units, $R^2_3SiO_{1/2}$ siloxane units and $SiO_{4/2}$ siloxane units.

Component (C) can be prepared by the method of Shirahata, U.S. Pat. No. 4,707,531 which is incorporated herein by reference to show how to prepare component (C).

The amounts of components (A), (B) and (C) to be used in the compositions of this invention are such as to provide from 0.5 to 1.5, preferably 0.7 to 1.4, silicon-bonded hydrogen atoms for every alkenyl radical in the composition, and from 10 to 100, preferably 20 to 60, parts by weight of component (B) for every 100 parts by weight of component (A).

Component (D) in the compositions of this invention can be any platinum containing component that will catalyze an addition reaction between the silicon-bonded hydrogen atoms of component (C) and the alkenyl radials of components (A) and (B). Platinum can be used in its metallic form, optionally deposited on a carrier, or in its compounded and/or complexed form. Component (D) is preferably chloroplatinic acid, either in its hexahydrate form or as a vinyl siloxane complex thereof. Platinum catalysts are well known in the curable silicone composition art and need no further delineation herein. U.S. Pat. No. 3,419,593 to Willing is incorporated herein by reference to show a preferred component (D) for the compositions of this invention.

(D) is to be used in the compositions of this invention in such an amount as to increase the rate of curing of the composition at room temperature. While this amount cannot be rigorously specified, since it depends upon the particular material that is used, as a general matter it should be sufficient to provide from 1 to 1,000, preferably 1 to 100 parts of platinum for every one million parts by weight of components (A)+(B)+(C).

Component (E) can be any of the well known platinum catalyst inhibitors that are used in the curable silicone arts. Examples of component (E) include acetylene alcohols, such as 3-methyl-1-butyne-3-ol, 3,5-dimethyl-1-hexyne-3-ol and phenylbutynol, ene-ynes, such as 3-methyl-3-pentene-1-yne and 3,5-dimethyl-3-hexene-1-yne; and cyclopolymethyl-vinyl siloxanes.

Component (E) should be used in a quantity that will provide a useful work time for the composition after it has been prepared. While this amount cannot be rigorously specified it will fall within the range of 0.001 to 5, preferably 0.01 to 1, parts by weight for 100 parts by weight of component (A).

The disclosure of U.S. Pat. No. 3,445,420 to Kookootsedes and Plueddemann is incorporated herein by reference to show acetylenic alcohol inhibitors and the amounts there of that are effective. The disclosures of U.S. Pat. Nos. 4,465,818, 4,472,563 and 4,559,396 to Shirahata et.al Chandra et.al. and Sasaki et.al. respectively, are incorporated herein by reference to show ene-yne alcohol inhibitors and the amounts thereof that are effective.

Component (F) can be any carbonyl iron powder, such as basic carbonyl iron powder that is obtained by a thermal process, or basic carbonyl iron powder that has received further treatment. The disclosures of U.S. Pat. No. 4,731,191 to Swihart and application Ser. Nos. 815,436 and 360,949 to Fey are incorporated herein by reference to teach how to prepare and/or treat basic carbonyl iron powder.

The amount of component (F) to be used in the compositions of this invention is not critical; however, it is preferred that it be in the range of 50 to 90, and preferably 80 to 90, percent by weight, based on the weight of the composition. It is expected that an insufficient radar-attenuating effect is obtained when the iron content is below 50 percent. On the other hand, when the iron content exceeds 90 percent the compositions are unsuitable for fabricating elastomeric articles.

The compositions of this invention can be prepared by simply mixing the recited components to homogeniety. It is preferred to mix CIP with the siloxane polymers and then add the inhibitor and catalyst, in that order, to the resulting mixture. It is especially preferred to prepare the compositions of this invention in two or more non-curing packages which keep the catalyst separate from the organohydrogenpolysiloxane component until the composition is to be used; and then to mix said packages to prepare the curable composition.

To aid in said mixing it is preferred to prepare and use component (B) as a solution in a hydrocarbon solvent, such as toluene, xylene, heptane, etc. After the composition has been thoroughly mixed the solvent content thereof can be adjusted to facilitate the use of the composition. For example, compositions of this invention that are to be applied as a coating by spraying should have a viscosity of less than 50,000 centipoise, and preferably less than 10,000 centipoise at 25° C. Compositions of this invention that are to be used to formulate articles by press molding or injection molding should be substantially free of solvent. By "substantially free" it is meant less than about 5 percent by weight of solvent in the composition.

The compositions of this invention are useful as radar attenuating coatings for vehicles such as aircraft, ships and tanks, and for stationary structures such as buildings and towers. The coating can be applied as a curable liquid and cured in-place or formulated as a cured article, such as a sheet stock, and then adhered to a desired substrate.

The following examples are disclosed to further teach how to practice the present invention, which is delineated by the appended claims. All parts and percentages are by weight, unless otherwise stated. All viscosities are stated in centipoise at 25° C. Me, Ph and Vi denote the methyl, phenyl and vinyl radicals, respectively.

The following siloxanes were used for preparing compositions of this invention and comparison compositions. Siloxane A—A vinyl terminated polydimethylsiloxane having a viscosity of about 2,000. Siloxane B—A vinyl terminated polydimethylsiloxane having a viscosity of about 35,000. Siloxane C—A siloxane resin composed of $ViMe_2SiO_{1/2}$ units, $Me_3SiO_{1/2}$ units and $SiO_{4/2}$ units in a molar ratio of 0.15/0.6/1.0, respectively. Siloxane D—A $M_xQ$ siloxane resin composed of $HMe_2SiO_{1/2}$ units, $Me_3SiO_{1/2}$ units and $SiO_{4/2}$ units in a molar ratio of monovalent units to tetravalent units of 1.6/1, and having a silicon bonded hydrogen content of 0.95% and an Si—OH content of 0.45%. Siloxane E—A liquid copolymeric resin prepared according to U.S. Pat. No. 4,310,678, using equal amounts of a siloxane resin composed of $Me_3SiO_{1/2}$ units and $SiO_{4/2}$ units in a molar ratio of 0.6/1.0 and a trimethylsiloxy-terminated polymethylhydrogensiloxane having about 35 silicon atoms per molecule. Siloxane F—Cyclopolymethylvinylsiloxane having from 3–10 silicon atoms per molecule.

Examples 1–3

Three compositions of this invention and one comparison composition were prepared by mixing siloxanes, CIP, inhibitor and catalyst, in that order, as noted in Table 1, and press molding the resulting composition at 150° C. for 5 minutes. The cured compositions were tested for physical properties, as molded and after being exposed to a temperature of 450° F. for 16 hours in an air-circulating oven. These examples show that a composition of this invention comprising Siloxane A retains more elongation than a comparison composition of the art, when exposed to high temperature.

TABLE 1

| Component | Ex. 1 | Ex. 2 | Ex. 3 | Comparison |
|---|---|---|---|---|
| Siloxane A | 65 | 52 | — | — |
| Siloxane B | — | 3.2 | 120 | 159 |
| Siloxane C | 35 | 28.8 | 30 | 39.8 |
| Siloxane D | 4.5 | 6.6 | 13.5 | — |
| Siloxane E | — | — | — | 79.5 |
| Siloxane F | — | 0.8 | 1.5 | 2.0 |
| CIP | 399 | 330 | 660 | 1117 |
| Willing Catalyst | 0.08 | 0.67 | 0.12 | 1.4 |
| Methylbutynol | 0.08 | 0.16 | 0.12 | 0.4 |
| SiH/SiVi | 0.7 | 1.07 | 0.45 | 3.95 |
| Properties As Molded | | | | |
| Durometer | 85 | 90 | 57 | 85 |
| Tensile (psi) | 921 | 995 | 595 | 685 |
| Elongation (%) | 28 | 16 | 111 | 47 |
| 16 hrs./450° F.* | | | | |
| Durometer | 107 | 103 | 135 | 109 |
| Tensile | 83 | 69 | 59 | 127 |
| Elongation | 50 | 44 | 9 | 11 |

*% Retained

Examples 4–8

Five compositions of this invention were prepared by mixing 65 parts of Siloxane A, 35 parts of Siloxane C, 4.5 parts of one of the $M_xQ$ organohydrogenpolysiloxanes as detailed in Table 2, 399 parts of CIP, 0.08 parts of platinum complex catalyst and 0.08 parts of methylbutynol. The five compositions were press molded at 150° C. for 5 minutes and were tested for physical properties, as molded and after being oxposed to a temperature of 450° F. for 16 hours in an air circulating oven. The results are summarized in Table 2.

TABLE 2

| $M_xQ$* | Ex. 4 | Ex. 5 | Ex. 6 | Ex. 7 | Ex. 8 |
|---|---|---|---|---|---|
| x | 1.4 | 1.4 | 1.7 | 2.0 | 2.0 |
| % SiH | 0.52 | 0.91 | 0.7 | 0.53 | 0.91 |
| % SiOH | 1.09 | 0.77 | 0.75 | 0.96 | 0.33 |
| SiH/SiVi + SiOH | 0.38 | 0.67 | 0.51 | 0.39 | 0.68 |
| Property Retention | | | | | |
| Tensile (%) | 157 | 87 | 150 | 159 | 98 |
| Elongation (%) | 18 | 48 | 27 | 17 | 59 |

*Identical to siloxane D except having different values for x and for % SiH and % SiOH.

Examples 9–11

Three compositions of this invention were prepared as described in Example 1, press molded at 150° C. for 5 minutes and measured for physical properties as noted in Table 3. These compositions retain elastomeric properties after having been exposed to a temperature of 450° F., for over 400 hours in air.

TABLE 3

| Component | Ex. 9 | Ex. 10 | Ex. 11 |
|---|---|---|---|
| Siloxane A | 15.36 | 12.10 | 15.36 |
| Siloxane C | 3.26 | 6.52 | 3.26 |
| Siloxane D | 1.38 | 1.38 | 0.71 |
| CIP | 80 | 80 | 80 |
| Platinum Catalyst (ppm) | 2 | 8 | 8 |
| Methylbutynol | 0.006 | 0.02 | 0.02 |
| SiH/SiVi + SiOH | 2.4 | 1.4 | 1.2 |
| Properties As Molded | | | |
| Elongation (%) | 68 | 14 | 49 |
| Tear (p.l.i.) | 39 | 47 | 43 |

Example 12

A composition of this invention was prepared by mixing 900 parts of Siloxane A, 486 parts of Siloxane C, 8155 parts of CIP, 51.25 parts of Siloxane D, 2.2 parts of methylbutynol, 2.5 parts of chloroplatinic acid/vinyl siloxane complex and 75 parts of xylene. One portion of the composition was sprayed onto aluminum panels at thicknesses of 12–17 mils, 37–47 mils, and 57–67 mils thickness and cured condition to elastomeric coatings. Another portion of this composition was allowed to cure at room temperature and physical properties were measured after 1, 3, 7 and 21 days; tensile strength was found to be 246,309, 348, and 418 psi and the elongation was found to be 52, 46, 38 and 45 respectively. A third portion of the composition was press molded at 150° C. for 5 minutes. Its tensile strength and elongation were 418 psi and 44% respectively.

That which is claimed is:

1. A composition comprising (A) a polydiorganosiloxane which contains an average of at least two alkenyl radicals per molecule, the remaining organic radicals therein being at least 90 percent methyl radicals and up to 10 percent phenyl radicals, (B) a silicone resin component comprising $R^1R^2_2SiO_{1/2}$ siloxane units, $R^2_3SiO_{1/2}$ siloxane units and $SiO_{4/2}$ siloxane units in a ratio of from 0.1/0.6/1.0 to 0.25/0.9/1.0 wherein $R^1$ denotes an alkenyl radical and $R^2$ denotes a methyl or phenyl radical, (C) an organohydrogenpolysiloxane having the formula $M_xQ$ wherein M denotes a siloxane unit having the formula $R^3R^2_2SiO_{1/2}$, Q denotes a siloxane unit having the formula $SiOH_{4/2}$, x has a value of from 1.4 to 2.0, $R^3$ denotes H or $R^2$ and $R^2$ denotes methyl or phenyl, the amount of silicon bonded hydrogen atoms therein being 0.5 to 1.0 percent by weight, based on the weight of the organohydrogenpolysiloxane, (D) a platinum containing component in an amount sufficient to increase the curing rate of the composition at room temperature, (E) an inhibitor component in an amount sufficient to provide a work time for the composition at room temperature, and (F) from 50 to 90 percent by weight, based on the weight of the composition, of carbonyl iron powder; the amounts of (A), (B) and (C) being sufficient to provide from 0.5 to 1.5 silicon bonded hydrogen atoms for every silicon bonded alkenyl radical in the composition and from 10 to 100 parts by weight of (B) for every 100 parts by weight of (A).

2. A composition according to claim 1 wherein component (A) is a vinyl terminated polydimethylsiloxane. $R^2$ in components (B) and (C) denotes a methyl radical, component (D) is a vinyl siloxane complex of chloroplatinic acid and component (E) an acetylenic alcohol.

3. A composition according to claim 2 wherein component (A) has a viscosity of 2,000 centipoise at 25° C. and there is 20 to 60 parts of component (B) for every 100 parts of component (A), on a weight basis.

4. A composition according to claim 3 wherein component (F) comprises 80 to 90 percent of the composition, on a weight basis.

5. A composition according to claim 4 further comprising a viscosity lowering amount of a solvent for components (A), (B) and (C).

6. A composition according to claim 1 wherein components (B) and (C) each have a siloxane content of less than 0.5 percent by weight.

7. A composition according to claim 1 wherein the value of x is 1.6.

8. A composition according to claim 1 wherein component (D) is mixed with component (C) in a final mixing step.

9. A composition according to claim 1 having a viscosity of less than 50,000 centipoise at 25° C.

10. A composition according to claim 1 having less than about 5 percent by weight of a solvent.

* * * * *